United States Patent [19]

Sone et al.

[11] Patent Number: 4,932,165

[45] Date of Patent: Jun. 12, 1990

[54] METHOD OF POLISHING THE SURFACE OF ELECTROPHOTOGRAPHIC PHOTORECEPTOR

[75] Inventors: Masahiro Sone; Takahiro Suzuki; Yutaka Suzuki, all of Kanagawa, Japan

[73] Assignee: Fuji Xerox Co., Ltd., Tokyo, Japan

[21] Appl. No.: 239,826

[22] Filed: Sep. 2, 1988

[30] Foreign Application Priority Data

Sep. 3, 1987 [JP] Japan ..... 62-219048
Sep. 3, 1987 [JP] Japan ..... 62-219050

[51] Int. Cl.[5] ..... B24B 1/00

[52] U.S. Cl. ..... 51/281 R; 51/289 R; 51/326

[58] Field of Search ..... 51/281 R, 289, 326, 51/328

[56] References Cited

U.S. PATENT DOCUMENTS 3,438,156 4/1969 Lakso ..... 51/289 R
3,998,681 12/1976 Williams et al. ..... 51/281 R
4,483,107 11/1984 Tomoyori et al. ..... 51/281 R
4,599,827 7/1986 Goodwin ..... 51/281 R

FOREIGN PATENT DOCUMENTS 56-55477 5/1981 Japan .
56-82868 7/1981 Japan .
59-72446 4/1984 Japan .
60-142340 7/1985 Japan .

*Primary Examiner*—D. S. Meislin
*Assistant Examiner*—Jack Lavinder
*Attorney, Agent, or Firm*—Finnegan, Henderson, Farabow, Garrett and Dunner

[57] ABSTRACT

A two-stage method for polishing the surface of an electrophotographic photoreceptor drum having an inorganic selenic photosensitive layer wherein a first stage rough buffing is conducted by rotating a rough buffing roll about an axis parallel to the rotational axis of the photoreceptor drum, and a second stage polishing is conducted by rotating a finished buffing roll about an axis perpendicular to the rotational axis of the photoreceptor drum.

3 Claims, 2 Drawing Sheets

METHOD OF POLISHING THE SURFACE OF ELECTROPHOTOGRAPHIC PHOTORECEPTOR

BACKGROUND OF THE INVENTION

The present invention relates to a method of processing the surface of an electrophotographic photoreceptor having an inorganic selenic photosensitive layer.

When electrophotographic photoreceptors are manufactured, protrusions of selenium, protrusions of foreign substance, and flaws and the like tend to develop on the surfaces of selenic inorganic photosensitive layers formed by evaporation. These protrusions and flaws have to be removed because they may cause unsatisfactory cleaning. Moreover, such a photosensitive layer that has deteriorated has to be regenerated by polishing its surface to remove the deteriorated portion.

It is known to polish the surface of such a selenic inorganic photosensitive layer for the purpose of removing the protrusions and flaws therefrom for re-utilizing the electrophotographic photoreceptor. Examples of references showing such polishing include Japanese Patent Applications (OPI) Nos. 55477/81, 82868/81, 72446/84 and 142340/85.

However, the conventional polishing methods are solely intended to remove the protrusions and flaws developed on the surface of the photosensitive layer or the badly deteriorated surface of the photosensitive layer. If the surface of such layer is excessively polished, to the extent that the protrusions and flaws thus produced become removed, its sensitivity is lessened. However, no consideration has been given to such lowered sensitivity.

An electrophotographic photoreceptor having an inorganic selenic photosensitive layer is usually provided with a protective layer on its inorganic selenic photosensitive layer. There are two methods of regenerating the electrophotographic photoreceptor provided with such a protective layer, which is typically a resin of the type generally used for this purpose. The first is a method of dissolving the protective resin layer using an organic solvent to remove the layer; and the second is a method of scraping off the protective resin layer by buffing. There has also recently been proposed, as an improved version of the latter, a method of polishing the surface with a polishing agent containing polishing grains dispersed in a solvent capable of dissolving resin (see, for example, Japanese Patent Applications (OPI) Nos. 55477/81, 82868/81).

The above-noted conventional methods of regenerating electrophotographic photoreceptors have several disadvantages. Although the inorganic selenic photosensitive layer is not badly affected when an organic solvent is used to remove the protective resin layer, it is difficult to completely peel off the protective resin layer. If a strong acid solvent is used, moreover, it acts on the inorganic selenic photosensitive layer and lowers the sensitivity.

In the method of scraping off the protective resin layer, the surface of the photosensitive layer has to be polished up to a certain thickness (of 0.01 to 1$\mu$ in order to scrape off the protective resin layer by buffing. The trouble in this case is that the electrophotographic photoreceptor thus regenerated suffers from a reduction in sensitivity. In the case of polishing by means of a polishing agent containing polishing grains dispersed in a solvent for dissolving the resin, the surface of the photosensitive layer has to be polished up to a certain thickness to completely remove the protective resin layer. This method also results in a sensitivity reduction.

In any event, no particular consideration of the surface imperfection of the photosensitive layer deprived of the protective layer has been taken into account in the conventional methods of regeneration.

A general object of the present invention is to overcome the above problems by providing a method of polishing the surface of an electrophotographic photoreceptor so that, when an electrophotographic photoreceptor having an inorganic selenic photosensitive layer is initially formed or regenerated, excellent electrophotographic characteristics are obtained. Other objects and advantages of the invention will be apparent from the following description of the invention.

SUMMARY OF THE INVENTION

The inventors have found that, if the surface of the inorganic selenic photosensitive layer is polished by buffing in two stages, as hereinafter described, when the electrophotographic photoreceptor is formed initially or later regenerated, the electrophotographic photoreceptor thus formed or regenerated has excellent electrophotographic characteristics, especially the sensitivity.

To overcome the above-mentioned problems and to achieve the objects of the invention there is provided a method of polishing the surface of an electrophotographic photoreceptor, which in accordance with the present invention, comprises buffing the surface of an electrophotographic photoreceptor drum having an inorganic selenic photosensitive layer in two stages. In the first stage, the surface of the drum is buffed with a rough buffing roll which is rotated about an axis parallel to the rotational axis of the photoreceptor drum. Then, in the second polishing stage, the drum is buffed with a finish buffing roll which is rotated about an axis perpendicular to the rotational axis of the photoreceptor drum.

A further object of the present invention is to obtain an electrophotographic photoreceptor having excellent electrophotographic characteristics by regenerating an electrophotographic photoreceptor having a protective layer on a inorganic selenic photosensitive layer.

The present inventors have discovered that, if the inorganic selenic photosensitive layer, from which a deteriorated or worn protective layer has been removed, is polished by buffing to cause it to have a predetermined surface profile, the electrophotographic photoreceptor thus regenerated has excellent electrophotographic characteristics, especially the sensitivity.

The present invention also provides a method of regenerating an electrophotographic photoreceptor having a protective layer on an inorganic selenic photosensitive layer. The method comprises removing the protective layer by buffing to provide a surface on the inorganic selenic photosensitive layer which has a mean roughness of not more than 1.0 $\mu$m, a square mean roughness of not more than 1.0 $\mu$m, and a mean crest-to-crest distance of not less than 200 $\mu$m.

DETAILED DESCRIPTION OF THE PREFERRED EMBODIMENTS

The preferred embodiments of the present invention will be discussed hereinafter with reference to the accompanying drawings.

An electrophotographic photoreceptor applicable in the use of the present invention has an inorganic selenic photosensitive layer on a conductive support deposited film of Se, Se—As alloy, Se—Te alloy, Se—Sb alloy, Se—Bi alloy or the like, preferably about 50 to 70 μm thick, is used as the inorganic selenic photosensitive layer.

Figure 1A:
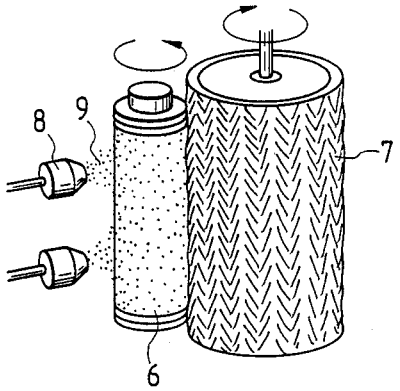
FIGS. 1(*a*) and 1(*b*) are diagrams illustrating the rough buffing method employed in the first stage of the present invention.
Figure 1B:
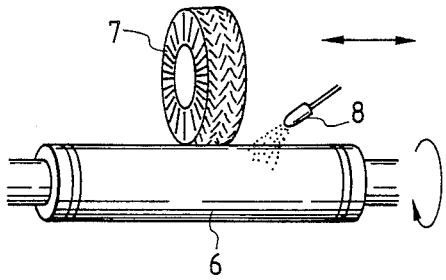

FIGS. 1(*a*), and 1(*b*) refer to a method of polishing an electrophotographic photoreceptor as a first embodiment of the present invention.

The inorganic selenic photosensitive layer formed by evaporation, or such a layer that has been deteriorated, is polished by buffing to remove the protrusions and flaws developed on the deposited surface, or the surface that has deteriorated in use. Rough buffing is applied in the first stage.

The rough buffing is conducted by the method depicted in FIGS. 1(*a*) and 1(*b*). More specifically, a rough buffing roll 7 (e.g., formed of cotton, flannel or the like) is placed in contact with a the circumferential surface of photoreceptor drum 6 being regenerated. The buffing roll 7 and the drum 6 are rotated in opposite directions and a polishing agent is sprayed from a spray nozzle 8 on the surface of the drum 6 while the rough buffing roll 7 is rotated in the direction opposite that of the drum rotation. When a thin-wall rough buffing roll 7 is used as shown in FIG. 1(*b*), the buffing is conducted by rotating the rough buffing roll and reciprocating it along the axis of rotation of the photoreceptor drum. The axis of rotation of the rough buffing roll 7 is substantially parallel to the rotational axis of the drum 6. The protrusions and the flaws produced on the surface of the deposited layer, or the deteriorated surface portions of the photosensitive layer, are completely removed by the rough buffing. The photoreceptor drum thus processed by the rough buffing suffers a loss in sensitivity of almost 20%.

Figure 2:
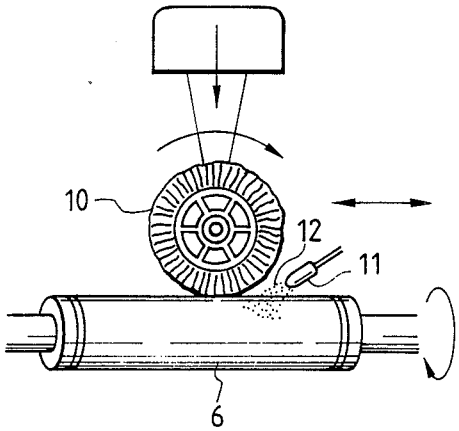
FIG. 2 is a diagram illustrating the mirror buffing method employed in the second stage of the present invention.

According to the present invention, the aforesaid rough buffing is followed by mirror buffing as a second stage. The method of mirror buffing is depicted in FIG. 2. That is, a finish buffing roll 10 (e.g., formed of flannel) is placed in contact with the surface of the photoreceptor drum 6 so that it rotates about an axis perpendicular to and is reciprocated along the axis of rotation of the photoreceptor drum 6 previously subjected to the rough buffing. A polishing agent 12 is sprayed from a spray nozzle 11 on the surface of the photoreceptor drum and the finish buffing roll 10 is moved toward the photoreceptor drum to contact the surface of the drum under a small buffing pressure in order to conduct the mirror buffing. In this case, the following settings are preferred: the speed of the finish buffing roll is about 600–1,000 rpm.; the moving speed of the finish buffing roll along the axis of the drum is about 0.5–1 meter per minutes (m/min); and the rotational speed of the photoreceptor drum is about 100–300 rpm.

When the finish buffing roll contacts the photoreceptor drum 6 and made rotatable in the circumferential direction thereof as in the case of the rough buffing roll, circumferential flaws left on the surface of the photoreceptor drum may cause black stripes to appear on a picture being formed. The finish buffing conducted by the above method shown in FIG. 2 will eliminate such flaws.

As the polishing agent for buffing, any generally known polishing substance, e.g., powdered ZnO, MgO, $SnO_2$, $Fe_2O_3$, CrO, $Cr_2O_3$, SiC, diamond powder or the like may be used.

The following experimental examples of the present invention will be described to illustrate the invention.

A photoreceptor drum having a photosensitive layer formed by depositing, under vacuum, a 60 μm thick layer of $As_2Se_3$ on an aluminum pipe 84 mm in diameter was used as an electrophotographic photoreceptor whose surface was to be polished. The photosensitive layer had surface defects (protrusions of selenium and foreign substance, flaws, etc.), which could cause unsatisfactory cleaning.

As shown in FIG. 1(*b*), rough buffing was conducted. In other words, the rough buffing roll was arranged so that its axis of rotation was parallel to the axis of rotation of the photoreceptor drum. While the photoreceptor drum was being rotated at a speed of 250 rpm, a slurry of polishing agents was sprayed from the spray nozzle onto the drum and, the rough buffing was conducted by rotating the rough buffing roll at a speed of 500 rpm and simultaneously reciprocating it toward the axis of rotation of the drum at a speed of 0.5 m/min.

The rough buffing roll used was formed of cotton and had a diameter of 30 cm. The polishing agent used was alumina having a particle size of 1 μm. When the surface profile was observed after the polishing agent was removed by rinsing, it was confirmed that protrusions 2–3 mmϕ in size and several hundred μm in height had been removed. Because of the rough buffing, the sensitivity of the photoreceptor drum decreased by nearly 20% compared with what it was prior to the rough buffing. This appeared attributable to the scattering of incident light due to the surface flaws resulting from the rough buffing.

The finish buffing roll was subsequently installed so that it was rotatable about an axis perpendicular to the axis of rotation of the photoreceptor drum and the mirror buffing was conducted. The photoreceptor drum was rotated at a speed of 100 rpm and a slurry of polishing agent was sprayed from the spray nozzle while the finish buffing roll was rotated at a speed of 700 rpm. The finish buffing roll was reciprocated three times along the longitudinal axis of the photoreceptor drum at a speed of 0.5 m/min.

The finish buffing roll was made of flannel and had a diameter of 25 cm. As for the polishing agent, aluminum oxide having a particle diameter of 0.3 μm was used. When the surface profile was observed after the polishing agent was removed by rinsing, mean roughness (Ra) on the center line was not more than 0.1 μm, and the mean square roughness (RMS) was not more than 0.1 μm. It was confirmed that the sensitivity reduction due to the rough buffing had completely been recovered because, upon measurement, the sensitivity of the photoreceptor ranged from 100 to 120%.

As described below, the polishing method is also effective in regenerating an electrophotographic photoreceptor having a protective layer on its inorganic selenic photosensitive layer.

Figure 3:
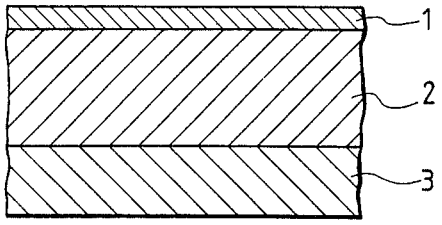
FIGS. 3 and 4 are sectional views of a typical electrophotographic photoreceptor having a protective layer to which the present invention is applied.
Figure 4:
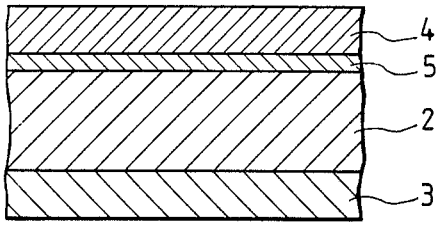
Figure 5:
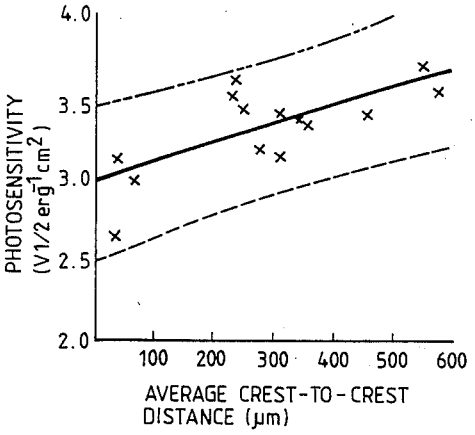
FIG. 5 is a graph showing the relationship of photosensitivity to the mean crest-to-crest distance to illustrate the effect of the present invention.

A second embodiment of the present invention refers to a case wherein the polishing method according to the present invention is employed in regenerating a electrophotographic photoreceptor having a protective layer. Referring to FIGS. 3–5 the following description will be given of this embodiment.

For the electrophotographic photoreceptor to which the second embodiment of the present invention is applied, a single protective layer shown in FIG. 3, or a multiple protective layer shown in FIG. 4, is used. As shown in FIG. 3, a thin film protective layer 1, an inorganic selenic photosensitive layer 2, and an aluminum substrate 3 may be placed on the photosensitive layer 2 and a thick film protective layer 4 placed on the blocking layer 5 to make the multiple protective layer shown in FIG. 4. A charge injection blocking layer 5 may constitute either a single, or multiple, protective layer.

The materials forming the protective layer may be any known combination of organic and inorganic materials, e.g., a protective layer composed of a metal oxide and a bonding resin is preferred. For the metal oxide, a mixture of tin oxide and antimony oxide, titanium oxide, zinc oxide, indium oxide or the like may be used. A known resin, e.g., polyurethane or polycarbonate, may be used as the bonding resin.

In the case of the photoreceptor shown in FIG. 3, the protective layer should preferably have a film thickness of 0.1–1 μm, whereas in the case of FIG. 4, a combination of the thick film protective layer 1–10 μm thick and the charge injection blocking layer 0.1–1 μm thick is preferred.

As the inorganic selenic photosensitive layer, a deposited film similar to that specified in the first embodiment is preferred.

Buffing in two stages, i.e., the combination of the rough buffing (FIGS. 1(*a*), 1(*b*)) and the finish buffing (FIG. 2) is also applied in the second embodiment. The buffing method is similar to the method in the above-described first embodiment.

In the second embodiment, the surface of the inorganic selenic photosensitive layer is buffed to provide the following surface characteristics: a mean roughness (Ra) at not more than 1.0 μm, preferably not more than 0.8 μm; mean square roughness (RMS) at not more than 1.0 μm, preferably not more than 0.8 μm; and mean crest-to-crest distance (Sm) of not less than 200 μm, preferably not less than 300μ.

The present invention will now be described with reference to an experimental example.

A photoreceptor drum having an $As_2Se_3$ layer 60 μm thick on an aluminum pipe 84 mm in diameter, a charge injection blocking layer 0.2 μm thick composed of zirconium butoxyde and KBM 503 (silane coupling material of Shin-Etsu Chemical Co.) and a thick film protective layer (3 μm thick) composed of urethane resin containing fine particles of tin oxide dispersed therein was used as an electrophotographic photoreceptor, the surface of which was to be polished.

As shown in FIG. 1(*a*), the rough buffing roll was arranged with its axis of rotation in parallel to the axis of rotation of the photoreceptor drum. The photoreceptor drum was rotated at a speed of 250 rpm and a slurry of polishing agent was sprayed from the spray nozzle while the rough buffing roll was rotated at a speed of 500 rpm to conduct rough buffing. The rough buffing roll was formed of cotton and had a diameter of 30 cm. Chrome oxide having a particle size of 1–5 μm was used as a polishing agent. As shown in FIG. 2, a finish polishing roll was subsequently installed so that it rotated about an axis perpendicular to the axis of rotation of the photoreceptor drum and was used to conduct the finish buffing. The photoreceptor drum was rotated at a speed of 100 rpm and a slurry of polishing agent was sprayed from the spray nozzle, while the finish buffing roll was rotated at a speed of 700 rpm. The finish buffing roll was reciprocated three times in the axial direction of the photoreceptor drum at a speed of 0.5 m/min. The finish buffing roll used was formed of flannel and had a diameter of 25 cm. As for the polishing agent, aluminum oxide having a particle diameter of 0.3 μm was used.

After the polishing process, the charge injection blocking layer and the protective layer was formed by the normal method to obtain a regenerated photoreceptor drum. When the surface profile and the sensitivity of the photoreceptor drum were examined, the results shown in Table 1 were obtained. The values in Table 1 represent mean values of those resulting from the measurements repeated four times. For comparison, there are simultaneously shown the results obtained in the cases where rough buffing only was conducted and a "green condition" i.e., without any deterioration of the photoreceptor drum.

TABLE 1

| | Mean roughness on center line (μm) | Square mean roughness (μm) | Mean crest-to-crest distance (μm) | Sensitivity (550 nm) $V1/2\ erg^{-1}cm^2$ |
|---|---|---|---|---|
| Present invention: | 0.05 | 0.06 | 400 | 3.4 |
| Rough buffing: | 0.11 | 0.13 | 60 | 2.6 |
| Green: | 0.07 | 0.08 | 300 | 3.2 |

As is seen from the results shown in Table 1, no sensitivity reduction occurs in the case of the photoreceptor drum regenerated according to the present invention.

FIG. 5 is a graph showing the relation between the surface profile of the inorganic selenic photosensitive layer and the photosensitivity, wherein the axes of abscissas and ordinates represent, respectively, the photosensitivity and the mean crest-to-crest distance. A solid line and a dotted line designate a regression straight line by the minimum square method and 95% reliability, respectively.

As set forth above, the method of polishing the surface of the electrophotographic photoreceptor according to the present invention comprises buffing the surface thereof in two stages; namely, arranging a rough buffing roll so that it rotates in the circumferential direction of the photoreceptor drum that is, it rotates about an axis parallel to the rotational axis of the drum, in the first polishing stage, and disposing the finish buffing roll in such a manner that it rotates in the axial direction of the photoreceptor drum, that is, it rotates about an axis perpendicular to the rotational axis of the photoreceptor drum, in the second polishing stage. Accordingly, the electrophotographic photoreceptor thus obtained in this two stage process is free from sensitivity reduction attributable to polishing, and also is free from the appearance of black stripes at the time of the formation of an image.

In regenerating the electrophotographic photoreceptor having the protective layer on the inorganic selenic photosensitive layer by the method according to the present invention, the surface of the inorganic selenic photosensitive layer has a mean roughness of not more than 1.0 μm, a square mean roughness of not more than 1.0 μm, with a mean crest-to-crest distance of not less than 200 μm. In so doing, the electrophotographic photoreceptor thus regenerated is free form sensitivity reduction attributable to polishing and from the appearance of black stripes at the time of the formation of an image.

Having described preferred embodiments of the present invention, it is to be understood that variations and modifications thereof which fall within the spirit and scope of the invention will become apparent to those skilled in the art and the scope of the present invention is to be determined by the appended claims and their equivalents.

What is claimed is:

1. A two-stage method for polishing a surface of an electrophotographic photoreceptor drum having an inorganic selenic photosensitive layer comprising:

in a first stage (a) rotating the electrophotographic photoreceptor drum about its central and longitudinal axis in one direction;

(b) buffing the surface of said electrophotographic photoreceptor drum with a rough buffing roll which rotates around its central and non-radial axis in the opposite direction; and (c) arranging placement of the rough buffing roll so that its central rotational axis is parallel to the longitudinal rotational axis of the electrophotographic photoreceptor;

in a second stage, (a) buffing the surface of the electrophotographic photoreceptor drum with a finish buffing roll which rotates around its own central and non-radial axis in either a clockwise or counterclockwise direction; and (b) arranging placement of the finish buffing roll so that its central rotational axis is perpendicular to the longitudinal rotational axis of the electrophotographic photoreceptor.

2. The method of claim 1, wherein the surface of the inorganic selenic photosensitive layer after the finish buffing has a mean roughness of not more than 1.0 μm, a square mean roughness of not more than 1.0 μm and a mean crest-to-crest distance of not less than 200 μm.

3. The method of claim 2, wherein the finish buffing roll is rotated at a speed of from about 600 to 1000 rpm, the photoreceptor is rotated at a speed of from about 100 rpm to 300 rpm and the finish buffing roll is moved along the axis of the photoreceptor at a speed of from about 0.5 to 1 m/min.

* * * * *